US005248007A

United States Patent [19]

Watkins et al.

[11] Patent Number: 5,248,007

[45] Date of Patent: Sep. 28, 1993

[54] ELECTRONIC CONTROL SYSTEM FOR STAIR CLIMBING VEHICLE

[75] Inventors: Baxter R. Watkins, Foster City; Douglas J. Littlejohn; John H. Hessler, both of Sunnyvale; Havard L. Staggs; Chi-Foun Kuen, both of Mountain View, all of Calif.

[73] Assignee: Quest Technologies, Inc., Sunnyvale, Calif.

[21] Appl. No.: 604,652

[22] Filed: Nov. 1, 1990

Related U.S. Application Data

[63] Continuation-in-part of Ser. No. 440,054, Nov. 21, 1989, Pat. No. 5,123,495.

[51] Int. Cl.[5] ..... A61G 5/06

[52] U.S. Cl. ..... 180/9.32; 180/169; 180/65.8; 180/907; 280/DIG. 10; 364/424.01

[58] Field of Search ..... 180/9.32, 907, 167, 180/168, 169, 65.8, 65.1; 280/304.1, 250.1, DIG. 10; 364/424.01, 424.02, 424.07, 434

[56] References Cited

U.S. PATENT DOCUMENTS

| | | | |
|---|---|---|---|
| Re. 28,256 | 11/1974 | Zamotin | 280/5.22 |
| 2,765,860 | 10/1956 | Church | 180/6.4 |
| 3,068,950 | 12/1962 | Davidson | 180/9.23 |
| 3,077,345 | 2/1963 | Andersson et al. | 280/708 |
| 3,111,331 | 11/1963 | Locke | 180/9.23 |
| 3,127,188 | 3/1964 | Greub | 280/5.22 |
| 3,133,742 | 5/1964 | Richison et al. | 280/5.28 |
| 3,142,351 | 7/1964 | Green | 180/8.2 |
| 3,146,841 | 9/1964 | Locke | 280/5.22 |
| 3,166,138 | 1/1965 | Dunn, Jr. | 180/9.23 |
| 3,178,193 | 4/1965 | Grogan | 280/5.26 |
| 3,191,953 | 6/1965 | Aysta | 280/5.22 |
| 3,195,910 | 7/1965 | Steiner | 280/5.22 |
| 3,196,970 | 7/1965 | Brenner | 180/8.2 |
| 3,198,534 | 8/1965 | Porter | 280/5.22 |
| 3,204,716 | 9/1965 | Phillips et al. | 180/9.22 |
| 3,231,036 | 1/1966 | Appendrodt | 180/6.5 |
| 3,231,290 | 1/1966 | Weyer | 280/5.22 |
| 3,259,200 | 7/1966 | Maijala | 180/9.23 |
| 3,259,396 | 7/1966 | Zamotin | 280/5.22 |
| 3,288,234 | 11/1966 | Feliz | 180/6.5 |
| 3,292,722 | 12/1966 | Bamberg | 180/9.23 |
| 3,295,858 | 1/1967 | Addison, Jr. | 280/5.3 |
| 3,304,094 | 2/1967 | Wenger | 280/5.2 |
| 3,346,062 | 10/1967 | Richison et al. | 180/6.7 |
| 3,406,772 | 10/1968 | Ahrent et al. | 180/9.23 |
| 3,529,688 | 9/1970 | Bruce | 180/9.23 |
| 3,869,011 | 3/1975 | Jensen | 180/9.23 |
| 4,033,421 | 7/1977 | Ikarimoto | 180/8.2 |
| 4,061,199 | 12/1977 | Last | 180/8.2 |
| 4,077,483 | 3/1978 | Randolph | 180/6.5 |
| 4,119,163 | 10/1978 | Ball | 180/6.5 |
| 4,119,164 | 10/1978 | Fogg, Jr. et al. | 180/6.5 |
| 4,136,888 | 1/1979 | Bowie, Jr. et al. | 280/5.22 |
| 4,154,315 | 5/1979 | Rasmussen | 180/8.2 |
| 4,194,584 | 3/1980 | Kress et al. | 180/9.23 |
| 4,204,255 | 5/1980 | Cremer | 364/424.05 |
| 4,207,959 | 6/1980 | Youdin | 180/6.5 |
| 4,222,449 | 9/1980 | Feliz | 180/8.2 |
| 4,387,325 | 6/1983 | Klimo | 180/907 |
| 4,401,178 | 8/1983 | Studer | 180/8.2 |
| 4,411,330 | 10/1983 | Blokland | 180/8.2 |
| 4,421,336 | 12/1983 | Petrofsky et al. | 280/250.1 |
| 4,432,425 | 2/1984 | Nitzberg | 180/8.2 |

(List continued on next page.)

*Primary Examiner*—Margaret A. Focarino
*Assistant Examiner*—Anne Marie Boehler
*Attorney, Agent, or Firm*—Townsend and Townsend Khourie and Crew

[57] ABSTRACT

An electronic control system for a stair climbing vehicle, such as a wheelchair is disclosed. Front and back sensors are provided for detecting a stairway or slope. The electronic control system determines from the sensor data whether the slope has an acceptable incline for traversing. If it is not acceptable, the vehicle will be prevented from entering onto the stairway or slope. A seat for a user is tilted in accordance with electronic controls to keep the user approximately vertical with respect to gravity as the vehicle traverses the stairs. The allowed operation of the vehicle is controlled via parameters which can be changed by removable memory which configures the vehicle for a particular user or group of users.

12 Claims, 14 Drawing Sheets

U.S. PATENT DOCUMENTS

| | | | |
|---|---|---|---|
| 4,432,426 | 2/1984 | Misawa | 180/8.2 |
| 4,473,234 | 9/1984 | Egen | 280/5.22 |
| 4,556,229 | 12/1985 | Bihler et al. | 280/5.22 |
| 4,556,997 | 12/1985 | Takamiya et al. | 280/304.1 |
| 4,564,080 | 1/1986 | Pagett | 180/8.2 |
| 4,566,550 | 1/1986 | Misawa | 180/8.2 |
| 4,566,551 | 1/1986 | Feliz | 280/DIG. 10 |
| 4,566,706 | 1/1986 | Bihler et al. | 280/5.22 |
| 4,566,707 | 1/1986 | Nitzberg | 180/8.2 |
| 4,585,241 | 4/1986 | Misawa et al. | 280/5.22 |
| 4,620,285 | 10/1986 | Perdue | 364/424.02 |
| 4,627,508 | 12/1986 | Auer | 180/9.22 |
| 4,634,941 | 1/1987 | Klimo | 180/6.5 |
| 4,674,584 | 6/1987 | Watkins | 180/8.2 |
| 4,688,813 | 8/1987 | Misawa et al. | 280/5.22 |
| 4,733,355 | 3/1988 | Davidson et al. | 364/424.07 |
| 4,747,457 | 5/1988 | Buscaiolo et al. | 180/19.1 |
| 4,771,839 | 9/1988 | Misawa | 180/8.2 |
| 4,854,408 | 8/1989 | Beard et al. | 180/9.32 |
| 4,898,256 | 2/1990 | Lehner | 180/8.2 |
| 4,915,184 | 4/1990 | Watkins | 180/8.2 |
| 4,977,971 | 12/1990 | Crane | 180/9.32 |
| 5,033,000 | 7/1991 | Littlejohn et al. | 364/424.01 |
| 5,040,116 | 8/1991 | Evans et al. | 180/169 |
| 5,076,384 | 12/1991 | Wada et al. | 180/169 |
| 5,123,495 | 6/1992 | Littlejohn et al. | 280/DIG. 10 |

ELECTRONIC CONTROL SYSTEM FOR STAIR CLIMBING VEHICLE

This application is a continuation-in-part of pending application Ser. No. 07/440,054, filed Nov. 21, 1989, now U.S. Pat. No. 5,123,495.

Appendix I sets forth a control algorithm and Appendix II describes a joystick filtering algorithm.

BACKGROUND

The present invention relates to control systems for controlling the operation of a personal transport vehicle, such as a wheelchair, while climbing or descending stairs.

A major challenge for wheelchair designers has been to design a wheelchair which can safely and effectively ascend and descend stairs, and yet not be unduly large, cumbersome or expensive. One design is shown in U.S. Pat. No. 4,674,584. The wheelchair travels on normal wheels during horizontal operation, and has ultrasonic sensors detecting the presence of a stairway or other incline. The sensor signals are used to activate and lower a pair of tracks, which are looped endless treads. In addition to lowering the tracks, a signal from the ultrasonic sensors is also used to determine if the incline is too steep for the wheelchair to negotiate. In such an instance, the wheelchair will not be allowed to move forward and up or down the stairs.

One problem with movement down a stairway is that as a wheelchair edges over the stairway, it will suddenly tilt downward and slam onto the stairway, jolting the user or potentially injuring the user. A solution to this problem is described in U.S. Pat. No. 4,671,369. Forward and rearward arms are deployed beneath the wheelchair and extend downward over the stairs as the wheelchair approaches. As the body of the wheelchair begins to tilt down the stairs, the arm is already resting across the steps. A shock absorbing, fluid-filled cylinder between this extended arm and the body of the wheelchair ensures that the body of the wheelchair will slowly ease into position pointing down the stairway. The shock absorber is simply a tube with a piston extending through it and fluid therein to slow the movement of the piston through the cylinder. The '369 patent shows a mechanical linkage mechanism for deploying these cushioning arms.

In order to provide maximum comfort for a user during the ascending or descending of stairs, the seat is tilted so that the user is held horizontal while the body of the wheelchair is inclined. This tilting movement is also necessary to move the center of gravity of the wheelchair and the user to an appropriate position to allow it to safely climb the stairs. If the center of gravity is too far forward, away from the stairs, the wheelchair might roll. Thus, there is a danger, that without this tilting mechanism, and its attendant control of the center of gravity, the wheelchair could roll.

Motorized wheelchairs come in many different types, depending upon the abilities of the person expected to use the wheelchair. Some wheelchairs have stair climbing capabilities and other characteristics. A joystick is used as a typical input mechanism to control both the speed and direction of the wheelchair. However, some wheelchair users are unable to operate a joystick because of their disability. Other input mechanisms include voice control, head gear responsive to movements of the head, and an air pressure sensor responsive to blowing and sucking through a straw. Depending upon the type of input used, the input circuitry must be modified to handle input signals and provide the appropriate drive signals to the wheelchair motors in response.

In addition, even for a specific type of input, such as a joystick, there are variations among users. For instance, some users can operate s joystick only marginally since their hand may be constantly shaking. Thus, special filtering circuitry can be included to cancel out the effects of such shaking. In addition, a user may be able to only provide jerky movements, which would result in very rapid acceleration or deceleration unless modified. These modifications can be done by using different circuitry or providing switches as inputs to a processor in the back of the wheelchair which can be configured in accordance with a particular user's needs. Obviously, the use of such switches makes the circuitry complicated and requires a technician to configure the wheelchair for the particular user, adding to the costs. U.S. Pat. No. 4,634,941, for example, discloses in Col. 8 the use of variable resistances to control acceleration and deceleration.

Some wheelchairs are used in a multiple-user environment, such as a convalescent home, where the wheelchair must be reconfigured each time a new user is provided with the wheelchair. In addition, access to the wheelchair must be controlled where there is danger that a particular user may be injured in a wheelchair not adapted to that user's particular disabilities.

SUMMARY OF THE INVENTION

The present invention provides an electronic control system for a stair climbing vehicle, such as a wheelchair. Front and back sensors are provided for detecting a stairway or slope. The electronic control system determines from the sensor data whether the slope has an acceptable incline for traversing. If it is not acceptable, the vehicle will be prevented from entering onto the stairway or slope. A seat for the user is tilted in accordance with electronic controls to keep the user approximately vertical with respect to gravity as the vehicle traverses the stairs. The allowed operation of the vehicle is controlled via parameters which can be changed by removable memory which configures the vehicle for a particular user or group of users.

In a preferred embodiment, the vehicle is only allowed to go down a slope in the forward direction and up a slope backwards. A sensor is provided for detecting the angle of an incline, such as a staircase, before it is reached by the wheelchair. A control signal is provided to a motor for tilting the seat to cause the seat to be tilted to a predetermined minimum safe angle before the wheelchair reaches the staircase. The minimum safe angle is an angle of tilt at which the wheelchair will not roll over if the tilting mechanism should fail to completely rotate the seat to a vertical position and as the stairs are traversed. The minimum safe angle is determined by the position of the center of gravity of the wheelchair which is affected by the user's weight. If the seat does not achieve this minimum tilt, the wheelchair is prevented from going over the stairs.

A removable, programmable memory is provided which contains both a key code to enable only an authorized user or group of users to operate the vehicle and contains constants for use in algorithms which operates the vehicle in accordance with a prescription for that particular user's or group of users' needs. Control signals from an input, such as a joystick, are modified by an algorithm in accordance with the prescription for a particular user or group of users to control responsiveness, acceleration rate, maximum speed, etc. This prescription is stored in the programmable memory and loaded into the computer when the memory is inserted. The key code in the memory can allow various levels of access, with access for a particular user, a particular group, physician access and technician access.

A pair of inclinometers are provided. The first inclinometer detects variation from a Y axis from the rear to front of the wheelchair, in other words, variations from a horizontal position by tilting forward or backward. The second inclinometer detects variations from an X axis extending from one side to the other of the vehicle, in other words, tilting to one side or the other. As the vehicle moves up or down a stairway, the angle of the stairway is first calculated to determine a default Y axis variation. Different variations from the Y axis in combination with variations from the X axis are used to computationally determine the amount of angular displacement between the Y axis of the vehicle and the longitudinal axis of the stairway, or rotational skew, while moving up or down the stairway. Rotational skew beyond a safe amount is then prevented. This automatically prohibits rotational skew where the vehicle might become unstable.

The vehicle is provided with forward and rearward cushioning arms for cushioning the movement of the vehicle down onto a stairway when descending, and up onto a landing from the stairway when ascending. When descending, the electronic control system with the sensors determines whether the slope is acceptable and will always deploy the cushioning arm. When ascending, the cushioning arm is employed only after the vehicle has passed onto the last step, and not on a first or intermediate steps of a stairway. A determination of the incline of a stairway and presence of a second step is accomplished by two rearward sensors and the Y axis inclinometer. The first sensor is pointed at a slight angle downward while the second sensor is pointed at a greater angle downward. This gives two different viewpoints for detecting the "nose" of a step, or the junction between the riser and the tread (the flat part of the step that the foot is placed upon). The first sensor is able to detect the stair nose at a greater distance, while the second sensor can more accurately determine the exact location of the nose. For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1A:
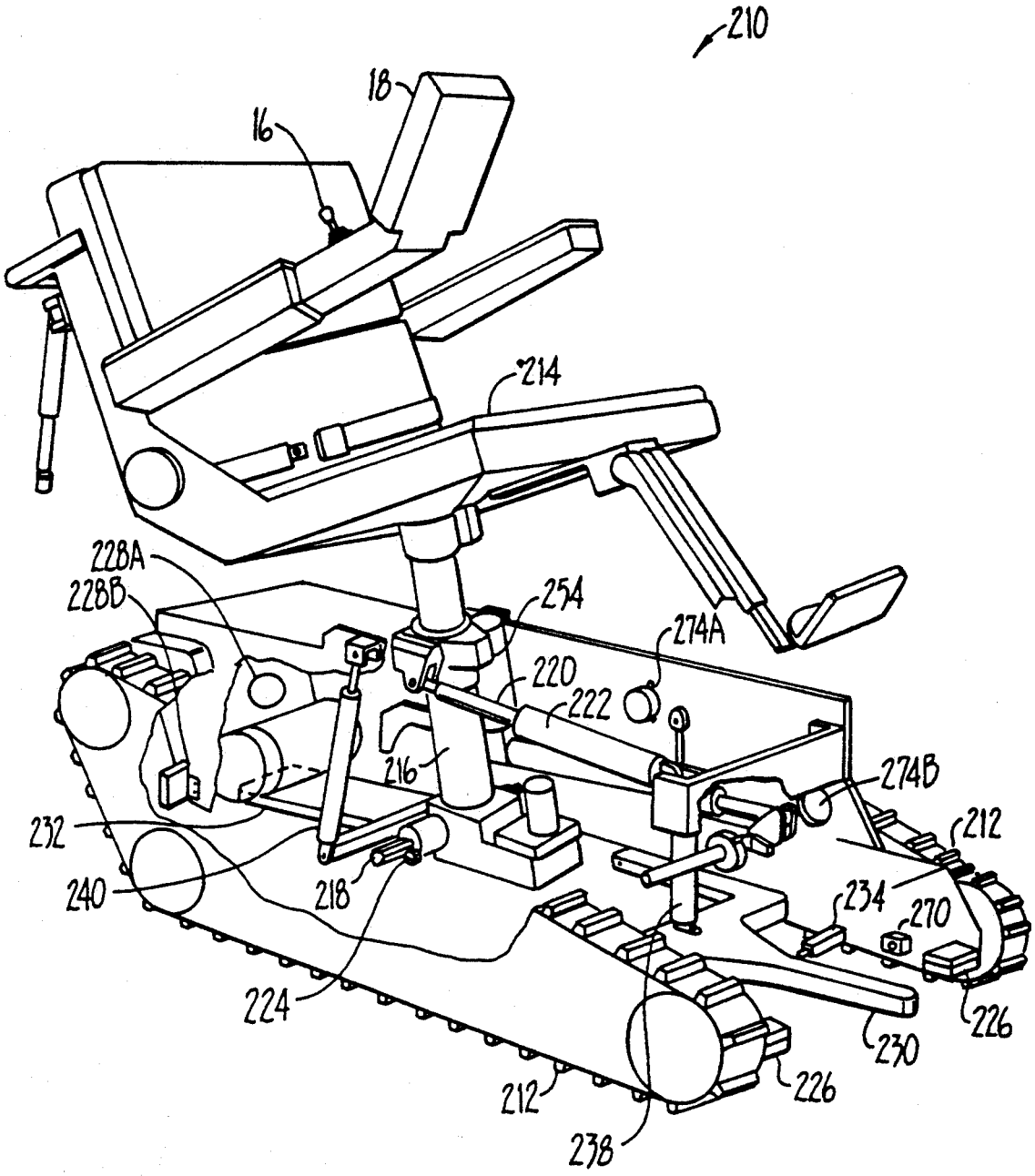
FIG. 1A is a perspective view of a motorized PTV utilizing the present invention.

FIG. 1A shows a wheelchair 210 according to the present invention. A pair of tracks 212 are used to move the wheelchair while ascending or descending an incline, such as a staircase. When not needed, the pair of tracks 212 can be raised so that the wheelchair can operate in the normal mode using its wheels. A seat 214 is supported by a post 216. Post 216 can be pivoted about a pivot point 218 with an arm 220. Arm 220 is coupled to a motor actuator 222 which moves arm 220 forward or backward to tilt seat 214.

A rotational resistive sensor 224 coupled to the bottom of post 216 is used to detect the actual tilt of the seat. A pair of forward ultrasonic sensors 226 detect the angle of the inclination of the surface the wheelchair is approaching. The rear ultrasonic detectors 228A and 228B are used when the wheelchair is ascending stairs, which is done in reverse.

FIG. 1A also shows inclinometers 274A and 274B for detecting the degree of inclination of the wheelchair frame. A signal from inclinometer 274A is used to control motor actuator 222 to maintain the bottom of seat 214 in a horizontal (with respect to gravity) position during normal operation.

Front and back cushioning arms 230 and 232 are provided to cushion the movement of the wheelchair while it is easing downward onto a staircase for descending (arm 230) or ascending onto a landing from a staircase (arm 232).

When the wheelchair is in position for descending a staircase, a solenoid retracts a latch which holds cushioning arm 230 in an up position. The force of gravity allows cushioning arm 230 to drop, so that it extends over and is in contact with the steps of a staircase. A similar solenoid and latch is used for rear cushioning arm 232. A sensor detects when arm 232 is in the up position. Optional sensors detect when the arms are in a down position. Piston and cylinder assemblies 238 and 240 couple cushioning arms 230 and 232, respectively, to the wheelchair frame. The top ends of cylinders 238 and 240 are coupled through hoses 248 and 250 to a reservoir of fluid 254. This arrangement is diagramed in FIG. 1B.

Figure 1B:
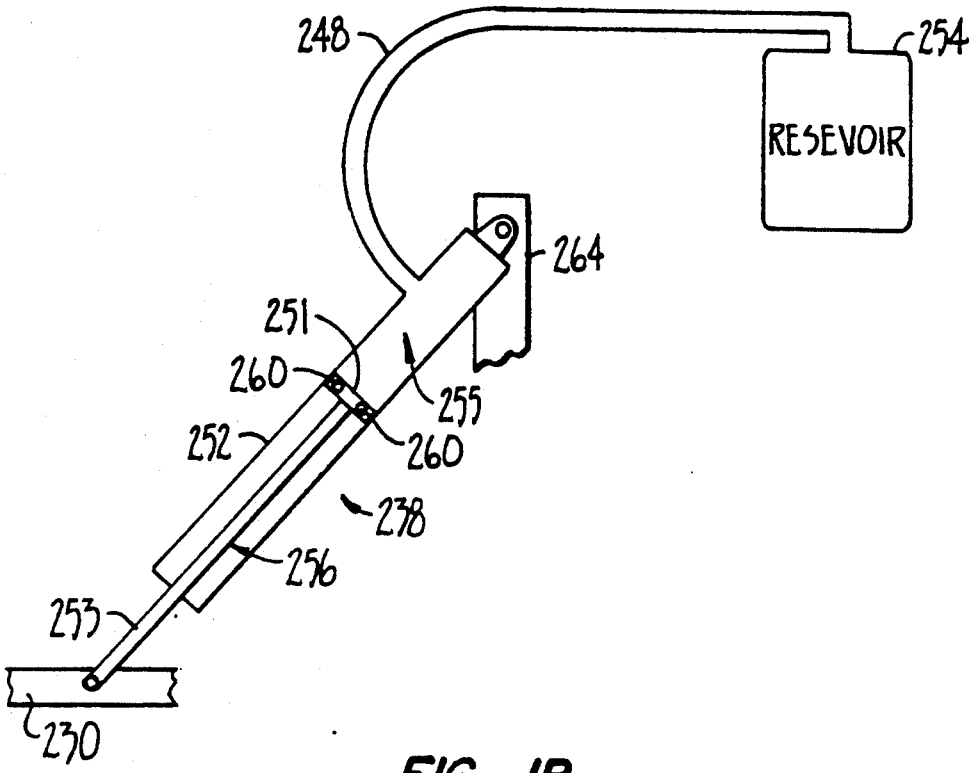
FIG. 1B is a diagram of the piston and cylinder arrangement for the easy-down of FIG. 1A.

FIG. 1B is a diagram of front cylinder assembly 238 coupled to front cushioning arm 230. A piston 251 is connected to a shaft 253 extending out of a hollow cylinder 252 which has a fluid in a top portion 255, and in a bottom portion 256. Internal to the piston is a one-way fixed orifice 260 providing restriction in one direction only. A hose 248 couples top portion 255 to a reservoir 254. Orifice 260 restricts the flow from the top portion 255 to the bottom portion 256, or vice-versa. Thus, as wheelchair frame 264, coupled to a top end of cylinder 252, tilts down a staircase, the restricted flow of valve 260 slows the compression by piston 251, thereby cushioning the tilting movement. Arm 230 is raised by a motor (not shown). When arm 230 is fully raised, a sensor 270 (see FIG. 1A) detects that it is in the up position and latched via latch 234.

The preferred fluid for use in cylinder 252 is a silicon based lubricant. This was chosen because it is a relatively clean fluid which also provides the necessary incompressibility and is inexpensive and readily available.

FIG. 1A shows a joystick 16 mounted on one arm of the chair along with a control panel 18 having a display and push buttons. The joystick and control panel could be on separate arms.

Figure 2:
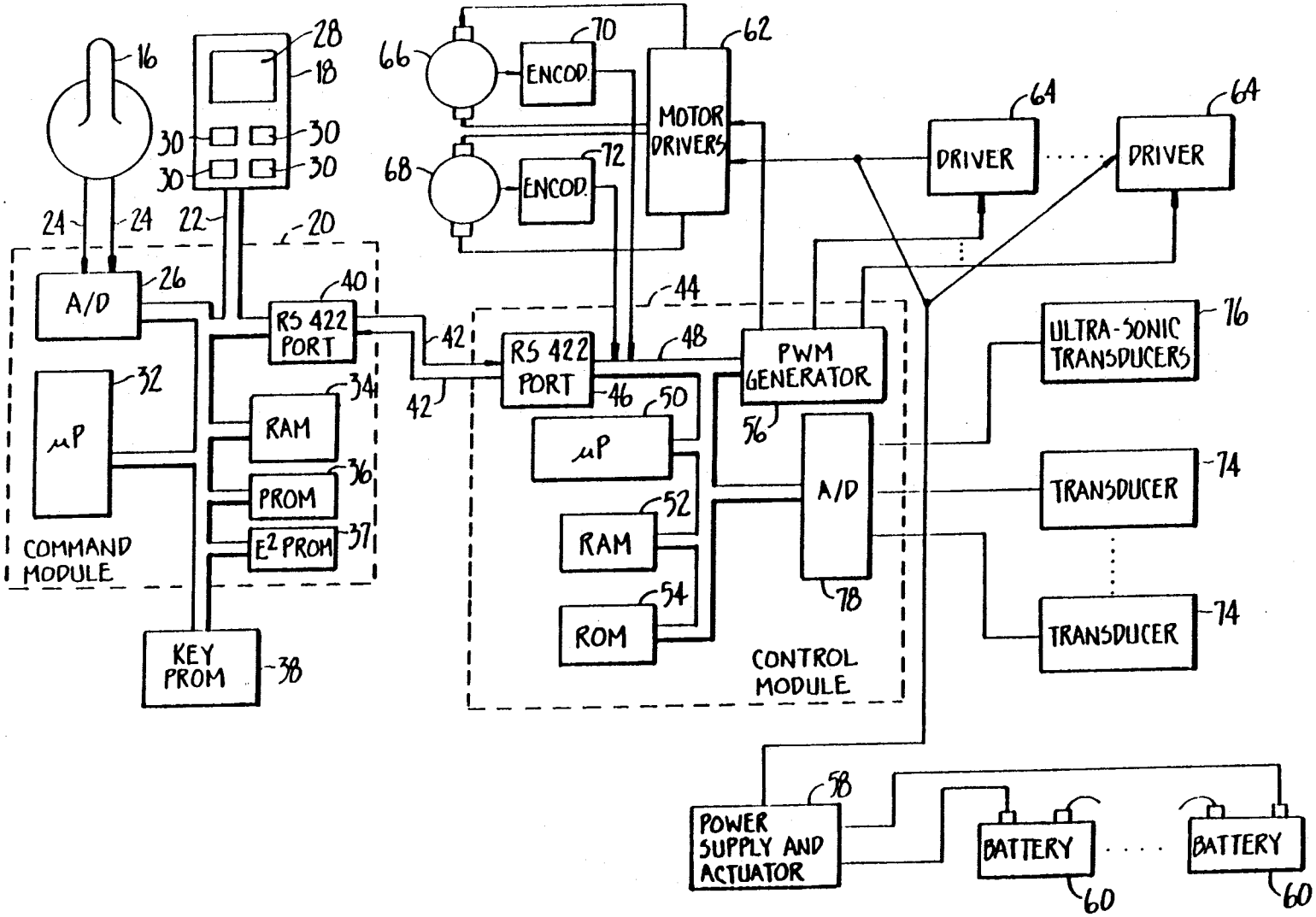
FIG. 2 is a block diagram of the control electronics of the present invention.

Referring to FIG. 2, the control signals from joystick 16 and control panel 18 are provided to a command module 20. The signals from control panel 18 are provided on an address and data bus 22. The signals from joystick 16, which are generated by variable reluctance sensors, are analog signals provided on lines 24 to an analog-to-digital converter 26 in command module 20. A/D converter 26 is coupled to bus 22.

Control panel 18 has a display 28 and push buttons 30. The push buttons are preferably large and easily depressed, and display 28 uses large letters for easy viewing by the user.

The operation of the command module is controlled by a microprocessor 32 which uses a random access memory (RAM) 34 and a programmable read only memory (PROM) 36 and an EEPROM 37. A key PROM 38 is coupled to bus 22, although it could be coupled directly to microprocessor 32. Key PROM 38 provides a code to enable activation of the motorized wheelchair and also provides constants for algorithms to process the input data and configure the wheelchair according to a prescription for a particular user, or group of users.

Joystick 16 could be replaced with other input devices, such as a straw which uses a suck and blow activation to produce changes in air pressure to air pressure sensors. These inputs would be similarly processed through A/D converter 26. Key PROM 38 would indicate the type of input used, and would provide the data needed by microprocessor 32 to accordingly modify the input data as appropriate for the type of input.

The key PROM contains a key password which is loaded into EEPROM 37 upon initialization of the wheelchair. Thereafter, that password is stored in EEPROM 37 and only a particular key PROM 38 having that password can activate the wheelchair. When the key PROM is inserted, microprocessor 32 compares the password with the password stored in EEPROM 37. Alternately, the user could be required to manually enter the password. Several different levels of key codes can be used, such as master (therapist and/or field service), group (clinical settings) and individual.

The key PROM is preferably electrically programmable (EEPROM) to allow changes to be made easily. A doctor can call the manufacturer with a new prescription and a new key PROM can be programmed and sent out. A new key PROM has a code indicating that it has not yet been used. When the contents of the new key PROM are loaded into EEPROM 37, the code in key PROM 38 is altered to indicate that it is a used key PROM. Thereafter, that key PROM 38 can only be used to activate the particular wheelchair which has the same key password stored in its EEPROM 37. In addition, all of the constants from the key PROM 38 are down-loaded into the EEPROM 37 in the command module, with the key PROM 38 then providing a redundant backup.

The key PROM 38 also contains constants needed to modify the control algorithm for the wheelchair in the areas of acceleration, deceleration, spasticity rejection, maximum speed (both translational and rotational) as well as general operating modes of the wheelchair.

Command module 20 includes a dual RS422 interface 40 coupled to a pair of serial links 42 to a control module 44. Two serial lines are provided to give full duplex communication with asynchronous capability. Communications are received by an RS422 interface 46 in control module 44 and provided to an address and data bus 48. A microprocessor 50, RAM 52 and ROM 54 are coupled to bus 48. Control module 44 provides controlled power to various motors through a pulse width modulation (PWM) generator 56 coupled to drivers 62, 64. Power supply 58 provides power from a series of batteries 60 and also controls the charging of these batteries. The output of PWM generator 56 is connected to motor drivers 62 for the PTV wheels and to additional drivers 64 for other motors or solenoids for controlling the position of the seat, the tilt of the seat back, the raised or lowered position of the stair climbing track, etc.

Motor drivers 62 are coupled to right and left wheel motors 66 and 68. Encoders 70 and 72 provide feedback from motors 66 and 68 to microprocessor 50 through an interface (see FIG. 4).

Figure 4:
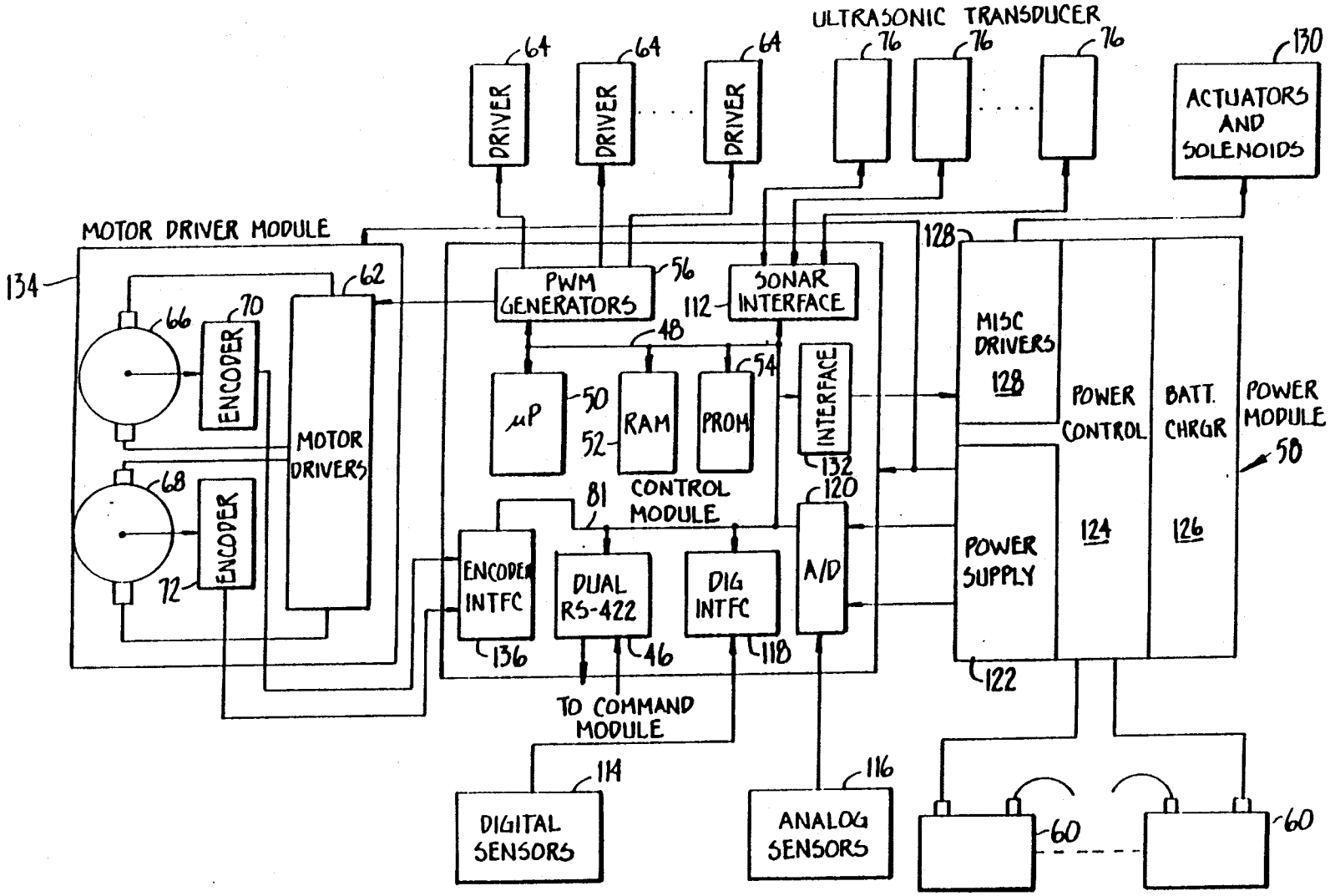
FIG. 4 is a block diagram of the control module of FIG. 2.

A number of transducers 74 and ultrasonic transducers 76 are coupled through an analog-to-digital converter 78 in control module 44. Alternately, a special sonar interface 112 may be used as shown in FIG. 4. In addition, sensors providing digital outputs may be used which may bypass A/D converter 78. These inputs can be multiplexed through a single A/D converter as shown in more detail in FIG. 4.

Figure 3:
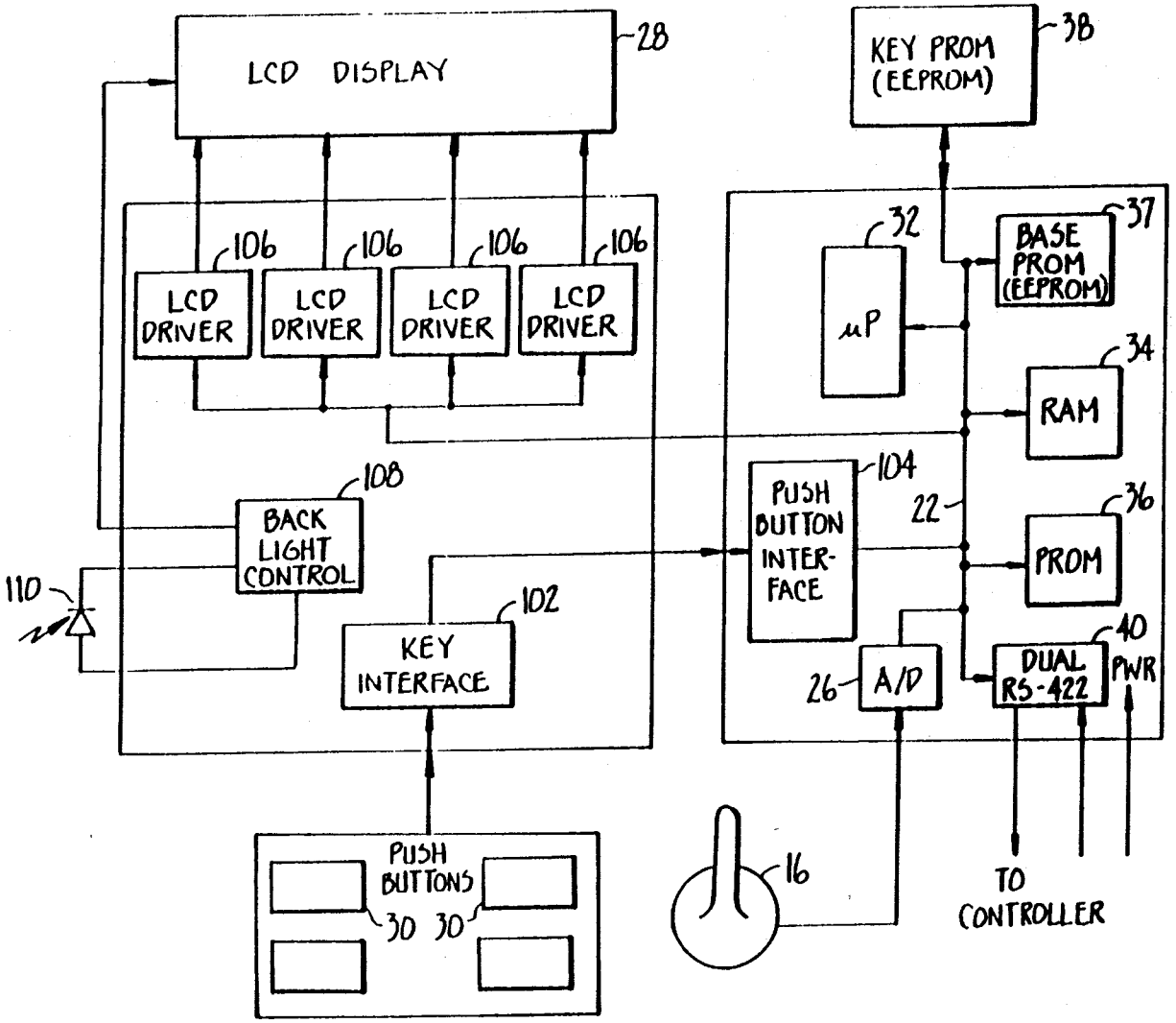
FIG. 3 is a block diagram of the command module of FIG. 2.

FIG. 3 shows command module 20 of FIG. 2 in more detail. In addition to the elements shown in FIG. 2, push-buttons 30 are coupled to microprocessor bus 22 via a key interface 102 and a second interface 104. A liquid crystal display (LCD) 28 is controlled by LCD drivers 106. Drivers 106 are in turn driven by microprocessor 32 with signals on bus 22. In addition a back light control circuit 108 controls a back light on LCD display 28 that senses ambient light conditions through a photo diode 110.

FIG. 4 shows the controller module in more detail. Ultrasonic transducers 76 are coupled to microprocessor bus 48 through a sonar interface 112. Microprocessor 50 sends the signals through interface 112 to drive transducers 76, and then monitors the echo signals.

In addition to the ultrasonic transducers, both digital sensors 114 and analog sensors 116 are provided. The digital sensor signals are provided through a digital interface 118 to microprocessor bus 48. The analog sensor signals are provided through an analog-to-digital converter 120 to microprocessor bus 48. In addition, monitoring signals from a power supply 122 in power module 58 are provided through A/D converter 120.

Power module 58 includes power supply 122, power control circuitry 124, battery charger circuit 126 and miscellaneous drivers 128. Drivers 128 are connected to miscellaneous actuators and solenoids 130. Drivers 128 are activated by microprocessor 50 through an interface 132.

A motor driver module 134 contains the motor, driver and encoder elements shown in FIG. 2. In addition, the signals from encoder 70 and 72 are provided through an encoder interface 136 to microprocessor bus 48.

Appendix I shows one basic example of dual algorithms for controlling the wheel motors with $X_{LO}$ being the left motor power and $X_{RO}$ being the right motor power. These two algorithms use a modified proportion, integral, derivative (PID) algorithm with component calculations and constants shown in Appendix I. Three constants are provided by key PROM 38. These are $K_t$, $K_r$, and $K_s$. In addition, the key PROM may provide the constants for other algorithms for controlling other aspects of the wheelchair through drivers 64 or other coefficients for the algorithm. It should be noted that constants $K_t$ and $K_r$ are applied to the filtering algorithm for command module 20 which is described in more detail in Appendix II.

The filtering algorithm of Appendix II is performed in command module 20. Basically, this provides deadbands near the center position of the joystick and along the X and Y axes so that the user can go in a straight line without holding the joystick exactly straight and can stay in one position despite modest movements of the joystick. In addition, the algorithm provides increased response sensitivity at slower speeds and decreased sensitivity at higher speeds to provide the user with more maneuverability at the lower speeds and prevent sharp turns at higher speeds. Additionally, spasticity filtering is done.

Key PROM 38 provides various constants for both the filtering algorithm in command module 20 and the control algorithm in control module 44, as well as other inputs to enable certain functions or set certain limits. Examples of these inputs are as follows:

1. Maximum angle the user is allowed to negotiate (9°–36°).
2. Maximum speed the user is allowed.
3. Reminder date of user's next appointment with the therapist for display on display 28.
4. Ability to enter the track mode for operating the wheelchair treads.
5. Ability to enter the stair climbing mode.
6. Ability to turn off the speech input mode (severely handicapped people may not want anyone to inadvertently switch off the speech).
7. Ability to set tilt and elevation of a chair (certain users should not be allowed to alter this).
8. Ability to turn off the ultrasonic drop-off detectors (this may be desirable for loading the wheelchair into a van, etc.).
9. Range (in miles and/or time) after which the chair will automatically go into a second level of functions, all of which are similarly programmable. This is provided so that the user does not necessarily have to go to the therapist to gain accessibility to higher functions when the user is expected to make certain progress in a certain time.

Figure 5:
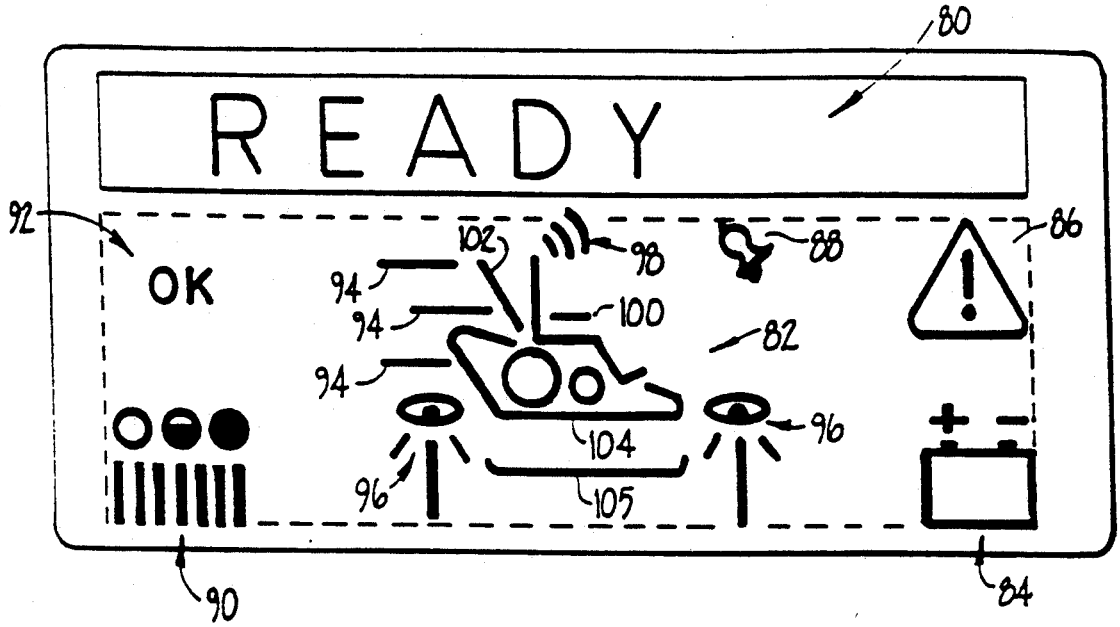
FIGS. 5 and 6 are diagrams of the visual display of the wheelchair of FIG. 1.

FIG. 5 shows the unique display of the present invention which includes a message display 80 and wheelchair icon 82. Also shown is a low battery indicator 84, a caution symbol 86, a bell indicator 88, a fuel level indicator 90 and a status indicator 92.

Figure 6:
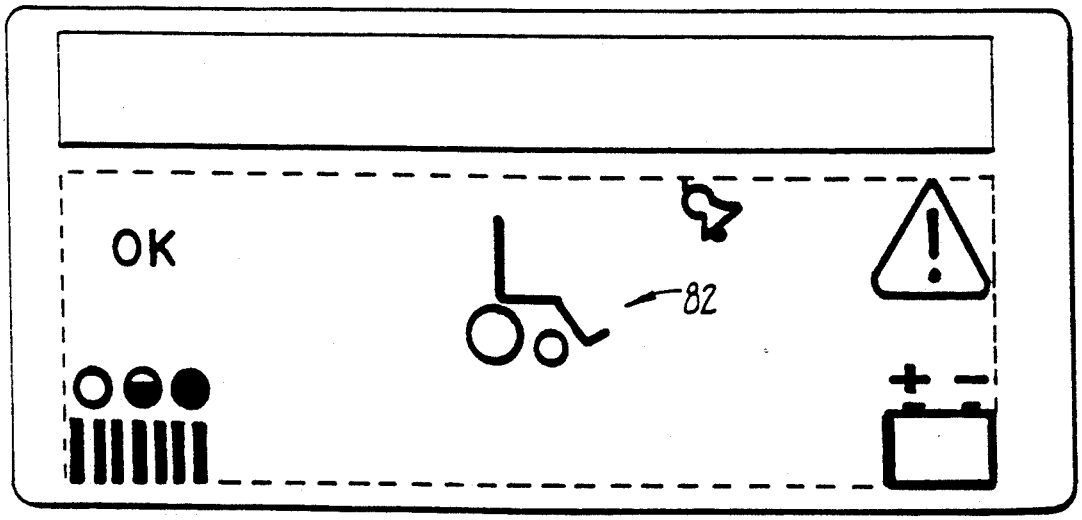

Wheelchair icon 82 has several elements which light up to indicate various status conditions. The basic wheelchair icon without any of the status indicators lit up is shown in FIG. 6. The various elements shown in FIG. 5 are as follows. First, a high-speed mode is indicated by lines 94. The activation of the ultrasonic sensors is indicated by eyes and downward directed lines 96. The activation of the voice synthesizer is indicated by lines 98. A line 100 indicates that the seat is elevated and a line 102 indicates that the seat back is tilted backward. A line 104 indicates that the stair climbing track is activated. Line 105 indicates that an "easy down", which cushions downward movements on stairs is down and in position. Such an "easy down" is shown in U.S. Pat. No. 4,671,369.

Returning to FIG. 4, analog sensors 116 include seat tilt sensor 224 of FIG. 1A. Digital sensors 114 of FIG. 4 include inclinometers 274A and 274B of FIG. 1A.

Included in the actuators and solenoids are the solenoid latches for releasing for the easy downs 230 and 232.

Motor drivers 62 are coupled to motors 66 and 68 for driving the wheels. Encoders 70 and 72 provide the feedback on the speed and direction of travel. The feedback from encoders 70, 72 is provided through encoder interface 136 to system bus 48. The same motors will also drive the tracks, when activated by a track lowering mechanism coupled to one of drivers 64. Drivers 64 also control the position of the seat and the tilt of the seat. These drivers are controlled through a pulse width modulator generator 56 coupled to system bus 48.

Figure 7A:
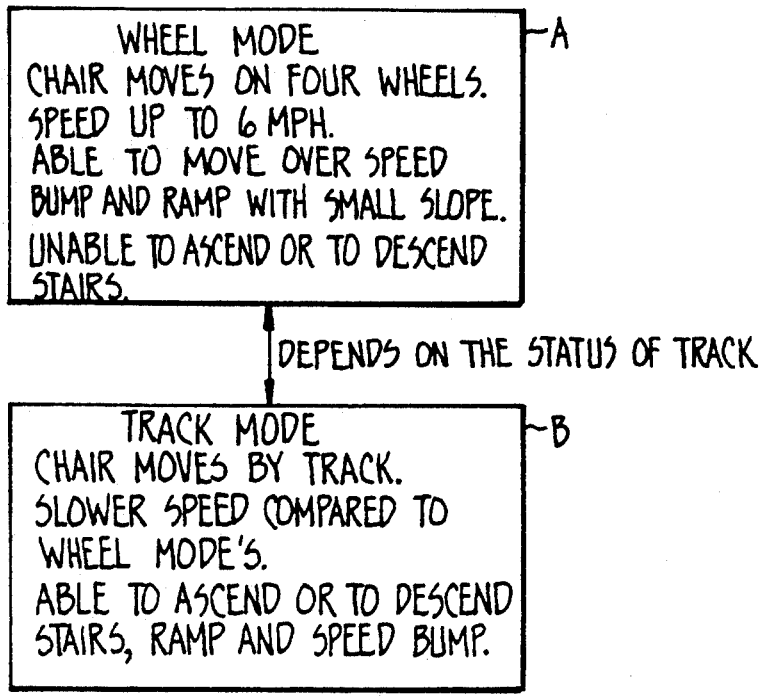
FIGS. 7A-7F are flow charts of the operation of the wheelchair of FIG. 1A during stair ascending or descending.

The operation of the stair-climbing wheelchair of the present invention will now be described with respect to flow charts 7A–7F. FIG. 7A is a mode diagram showing the transition between a wheel mode A and a track mode B. In the wheel mode, the wheelchair moves with four wheels and does not have the capability to ascend or descend stairs. In the track mode, the tracks are lowered upon detection of an incline of sufficient steepness by the ultrasonic transducers or upon an input request of the user. A single ultrasonic transducer for each direction could be used, with the microprocessor calculating the difference in distance to determine the variation in vertical height. Multiple ultrasonic transducers are used for increased reliability and reduced errors.

Figure 7B:
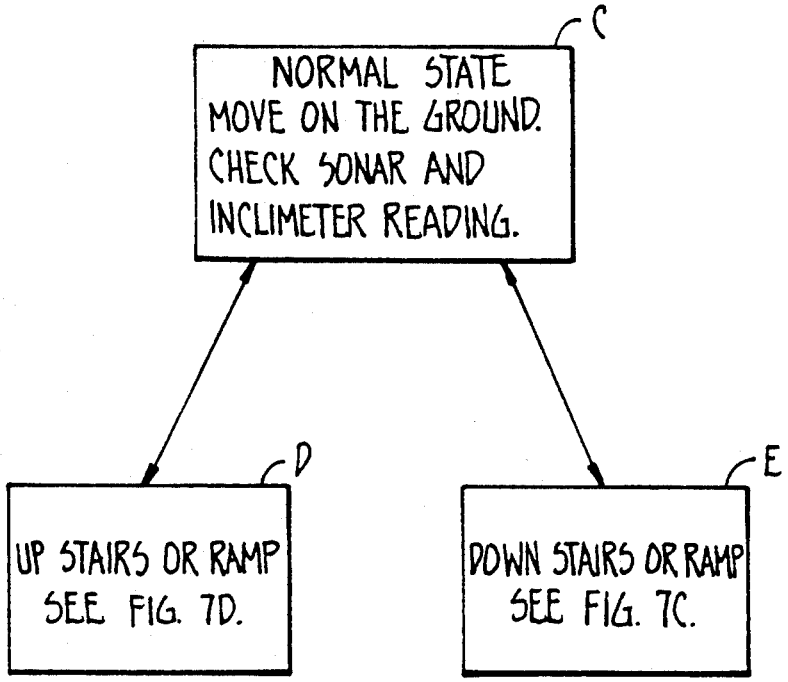

FIG. 7B is a track mode state diagram. In a normal state C, the wheelchair moves along horizontal ground, constantly checking the sonar (ultrasonic transducers) for vertical drops and also checking the inclinometer 274A. The seat tilt is adjusted in accordance with the inclinometer reading to maintain the user in a vertical position. Minor variations are filtered out so that the user is not constantly jostled around.

Figure 7C:
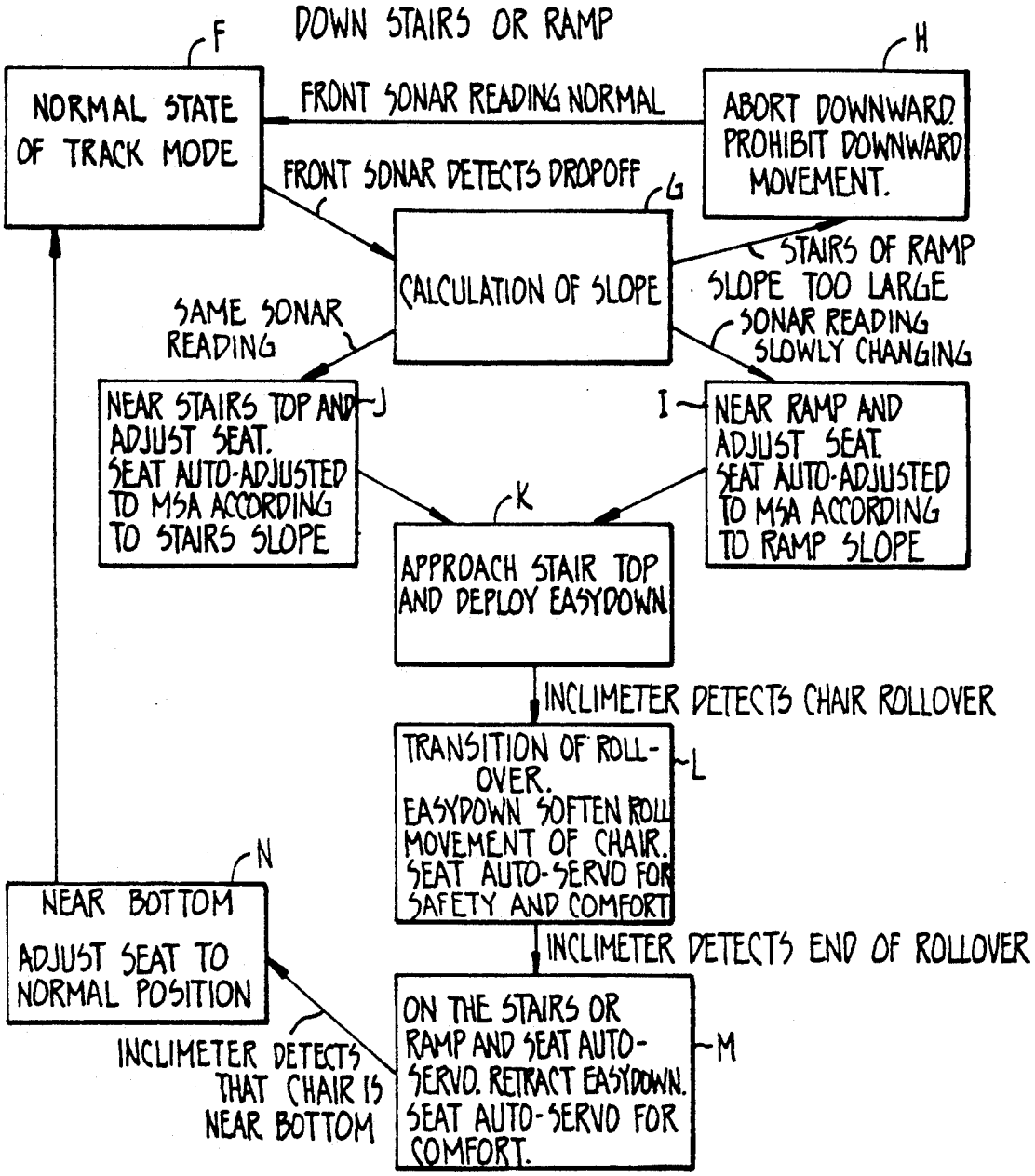
Figure 7D:
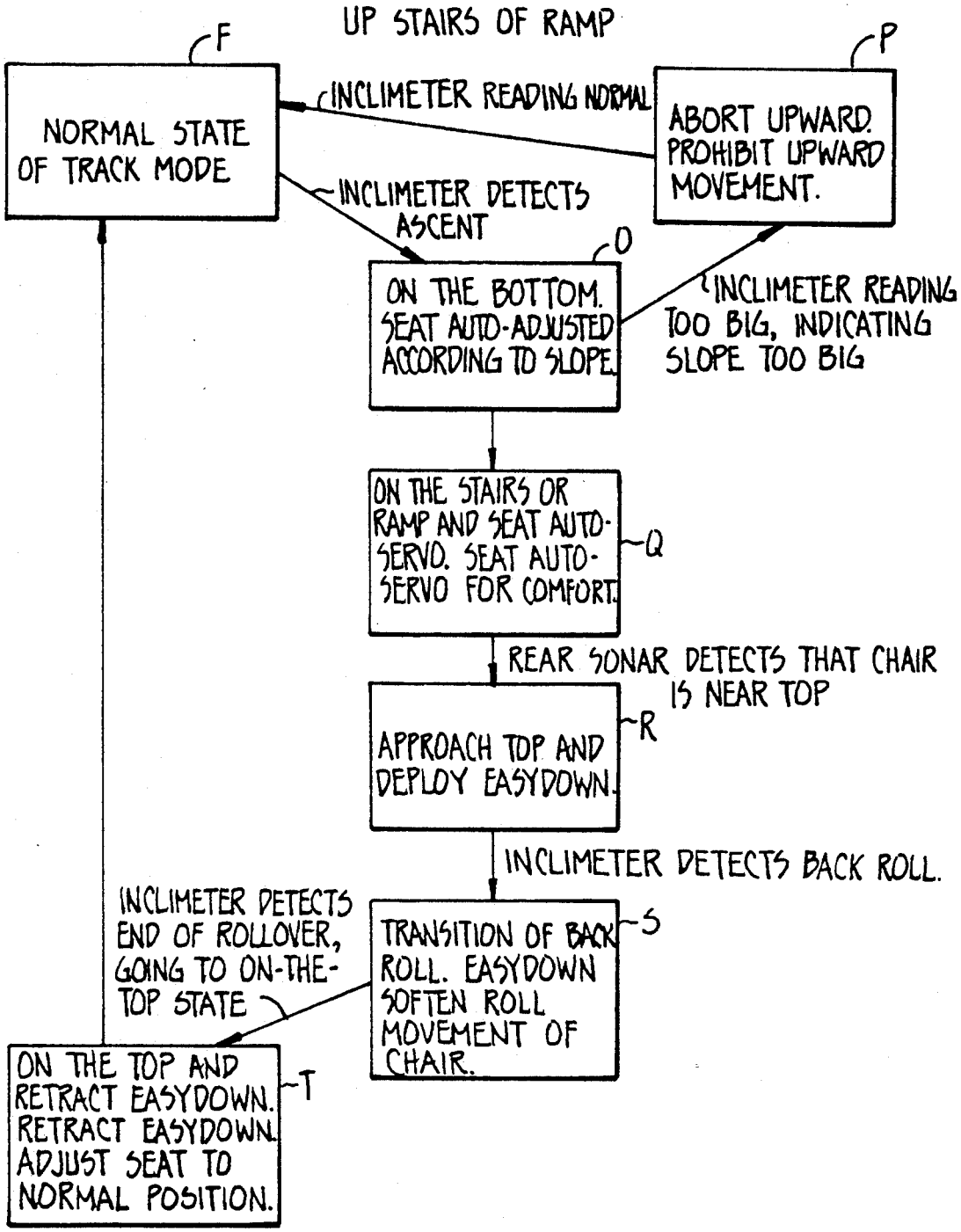

Upon detection of an upward vertical slope of sufficient incline, the wheelchair moves into the stairs or ramp mode D, shown in FIG. 7D. Upon detection of a vertical decline for a staircase or ramp, the wheelchair moves into state E in its program, shown in more detail in FIG. 7C.

For a downstairs ramp as shown in FIG. 7C, the first step, F, is to insure that the wheelchair is in the track mode. Next, the slope of the stairs or ramps is calculated (step G). For a staircase, the slope is measured by moving the wheelchair forward and detecting the distance between the first two stair risers. The slope can then be calculated by triangulation, knowing the distance between the steps and the depth of a step. Encoders 70, 72 will provide the distance travelled and an ultrasonic sensor(s) 76 will provide the change in depth. A ramp's angle can be calculated by looking at the rate of change over the change in distance traveled. If the ramp or steps are too steep, further forward movement is prohibited (step H).

If a ramp or staircase which is not too steep is detected, the wheelchair seat is adjusted to a minimum safe angle at the top of the ramp (step I) or the top of the staircase (step J).

The minimum safe angle (MSA) of the seat can be determined in advance for the maximum angle of incline the wheelchair will be allowed to negotiate. This is done using the known center of gravity of the wheelchair, as modified by the weight of a user or the extreme value of a range of weights for a range of users. The MSA is the calculated angle at which the user and seat should be tilted to avoid rolling over should further tilt operations fail. It can be used for lesser angles as well. Alternately, a separate MSA can be calculated for each incline angle. This calculation can be done each time, or the values could be stored in a table. The seat could also contain a weight sensor, which could modify the table to give further accuracy for each user of a group of users.

Once the wheelchair has adjusted its seat to the MSA, it deploys the front easy down, or cushioning arm 230 at the stair top (step K). The front easy down is deployed by retracting holding latch 234 as shown in FIG. 1A. The microprocessor checks sensor 270 to verify that the easy down is no longer in its up position. A separate sensor 233 may be included to verify that the easy down is in its down position. Otherwise, gravity may be relied upon.

After the easy down is deployed, the chair is moved forward and starts to roll over (step L). During roll over, the angle is detected by the inclinometer and the seat is adjusted accordingly to keep the user vertical with respect to gravity. During roll over, forward movement of the wheelchair is prohibited until it assumes its new angle. After the chair has settled at the angle of the staircase, the easy down is retracted (step M) with a motor or actuator.

Once the up sensor 270 detects the easy down in the up position, the wheelchair is allowed to proceed. When the wheelchair reaches the bottom of the staircase, the inclinometer will detect a change in angle, indicating that it is near the bottom. The seat will be adjusted to its normal position in accordance with the inclinometer reading (step N). When the chair is in the normal position, the wheelchair will be in its normal track mode (step F).

FIG. 7D shows the up stairs or up ramp mode of the program. The front ultrasonic transducer or inclinometer will detect an incline, and will prevent forward movement of the wheelchair up the incline. The user must turn the wheelchair around and approach the incline in reverse. As the wheelchair begins its ascent up the incline or stairs, the inclinometer 274A detects the angle of ascent and the presence of a nose is detected. The seat is adjusted accordingly (step O). If no nose is detected, indicating a ramp, movement up a predetermined steepness for a ramp is allowed. If the angle becomes too great, indicating too great of a slope, or if the nose of a next step is not detected, further upward movement is prohibited (step P). Otherwise, the wheelchair continues up the ramp and the seat is further moved to keep it in a vertical position with respect to gravity (step Q). When the rear ultrasonic transducer detects a landing at the top of the stairs or ramp, the rear easy down or cushioning arm 32 is deployed in a manner similar to the front easy down (step R). The presence of a landing is indicated by the failure to detect the riser of another step behind the chair. The inclinometer detects the backward roll of the wheelchair onto the landing as it is moved backward and the easy down will soften this movement (step S). There is no need to stop the rearward movement of the wheelchair at this time, with the inclinometer simply detecting the roll over, adjusting the seat accordingly and moving forward until the wheelchair assumes a horizontal position. There is no danger of roll over at this point, and therefore an early movement of the seat to an MSA is not necessary. At this point, the easy down is retracted (step T) in the same manner as the front easy down. The seat is constantly adjusted during the roll over to keep the user vertical and the wheelchair then enters the normal track mode F.

Figure 7E:
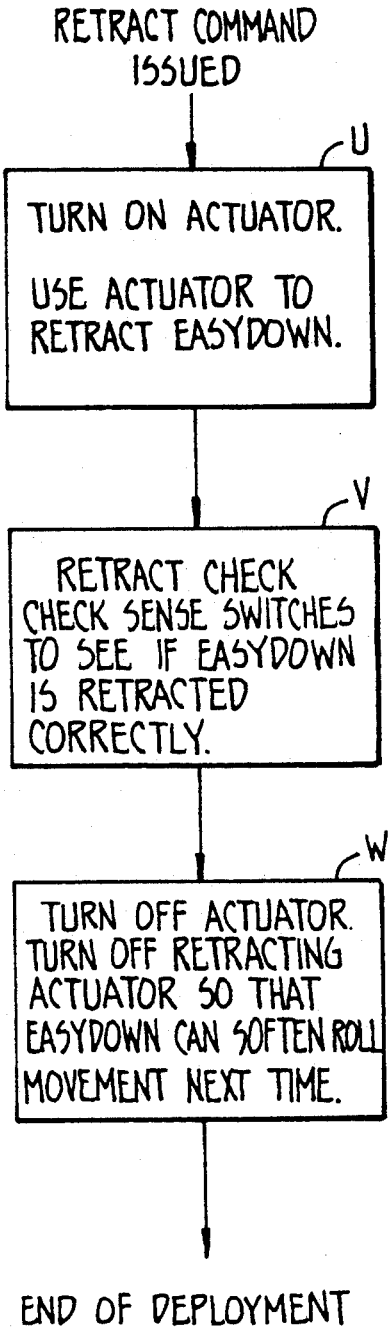

FIG. 7E shows the easy down retract state diagram in more detail. Once the retract command is received, a motor or actuator retracts the easy down (step U). Next, up sensor 270 is checked to make sure the easy down has been properly retracted (step V). The actuator is then turned off and holding latch 234 is inserted (step W) so that the easy down is ready for the next deployment.

Figure 7F:
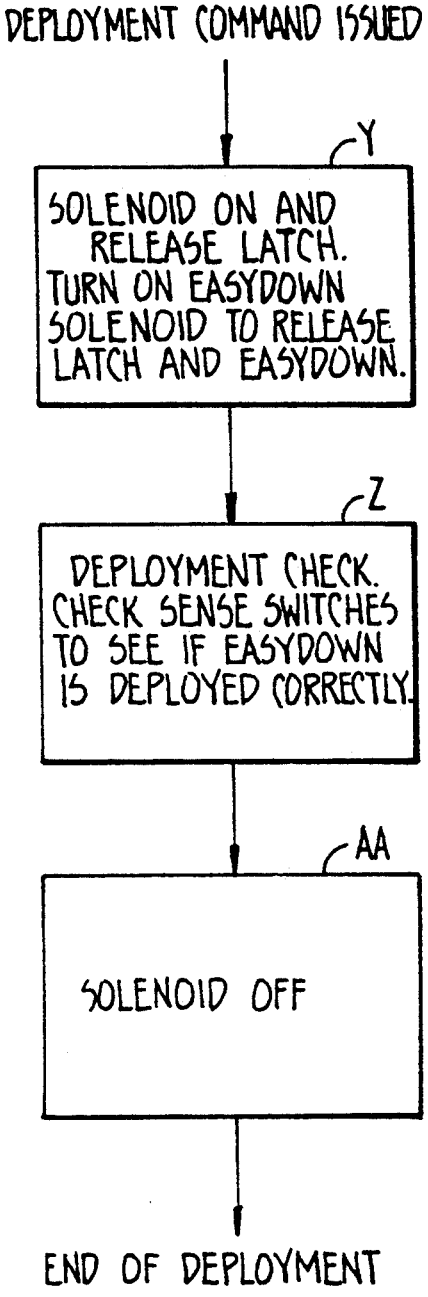

FIG. 7F shows the easy down deployment state diagram. When the deployment command is issued, a solenoid activates latch 234, which will release the easy down (step Y). Sensor 270 is then checked to determine that the easy down is no longer in the up position (step Z). The solenoid for retracting the latch is then turned off (step AA).

Figure 8A:
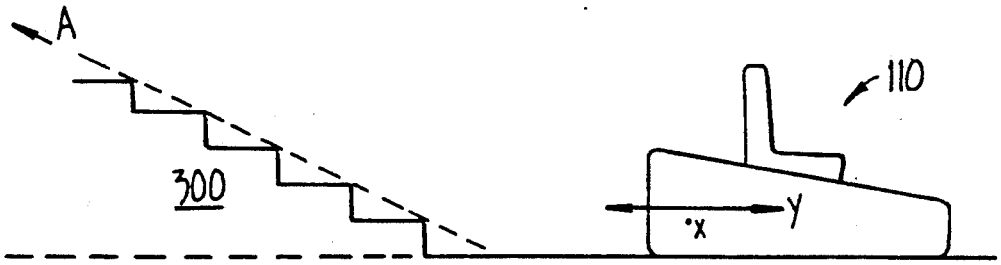
FIG. 8 is a diagram illustrating the rotational skew calculation.
Figure 8B:
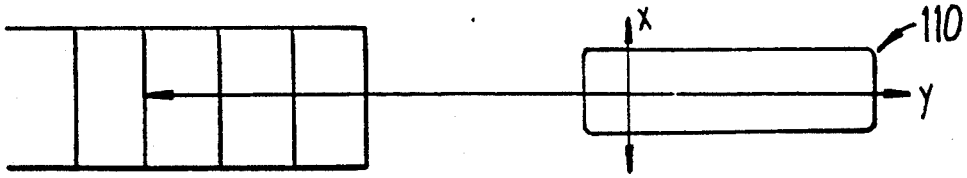

FIG. 8A illustrates the rotational skew calculation by the electronic control system of the present invention. The Y axis as shown in FIG. 8 extends from the back to front of the vehicle 110. The X axis extends from side to side, going in and out of the page in FIG. 8A. FIG. 8B is a top view of FIG. 8A, showing the X axis more clearly. When vehicle 110 is on stairway 300, the variation from the Y axis should be the slope of the stairway, A, if the vehicle is aligned so there is no X-axis variation. A pair of inclinometers 274A and 274B detect variations of the vehicle frame from the Y and X axes, respectively. As vehicle 110 moves up or down stairs 300, it is desirable to have it move in a straight line so that it does not veer off the side of the stairs in one direction or the other. One method of monitoring this is to have a 3-axis gyro which will provide a 3-dimensional position of the vehicle. In the present invention, the inclinometers are monitored with the vehicle going in a straight line as long as there is no variation from the X axis and the variation from the Y axis is equal to the stairway slope, A. Any variation in the X axis indicates that the vehicle is moving to the side.

The rotational skew, or sideways movement of the vehicle moving down the stairs can be determined from the values from the inclinometers. For a given amount of rotational skew R with Y constant, the value of X will change as A changes. Furthermore, with R and A constant, X will change as Y changes.

Figure 9A:
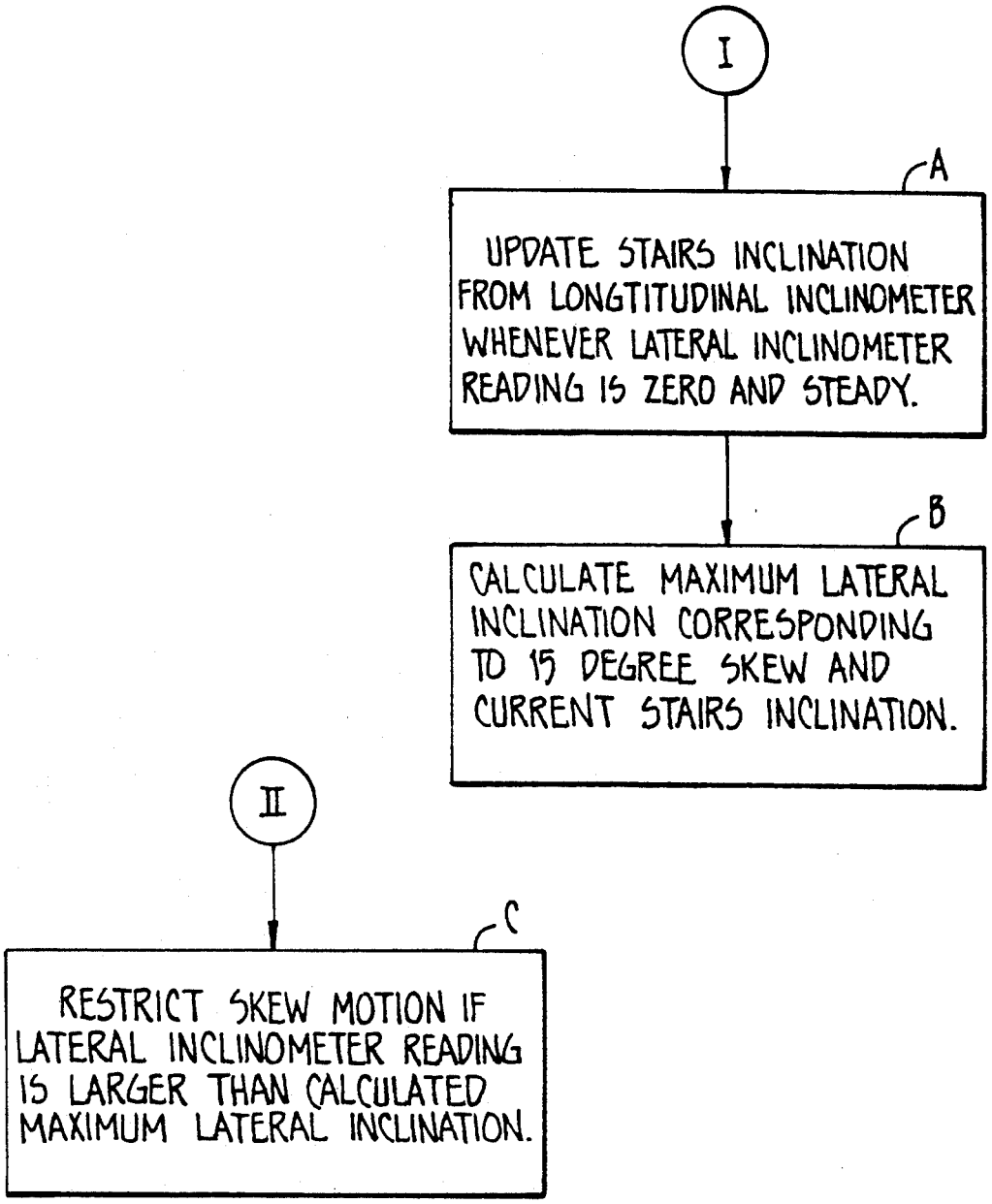
FIG. 9A is a flow chart of the rotational skew calculation.

The calculation of the rotational skew is illustrated by the flow chart of FIG. 9A. Two parallel calculations, I and II are shown. In one calculation, the inclination of the stairs is updated (step A) from the Y axis longitudinal inclinometer. This is done whenever the lateral X axis inclinometer reading is zero and steady, indicating that there is no variation from a straight path down the slope of the stairs, and accordingly the longitudinal Y axis inclinometer reading must be equal to the slope of the stairs. Next, the maximum lateral inclination is calculated (step B). This is done using a maximum 15° skew and the current stairway inclination. At the same time, a separate calculation is done to restrict the skew motion (step C). This is done if the lateral inclinometer reading is larger than the calculated maximum lateral inclination. In this situation, the vehicle will not be allowed to travel in any direction other than one which will reduce the skew.

Figure 9B:
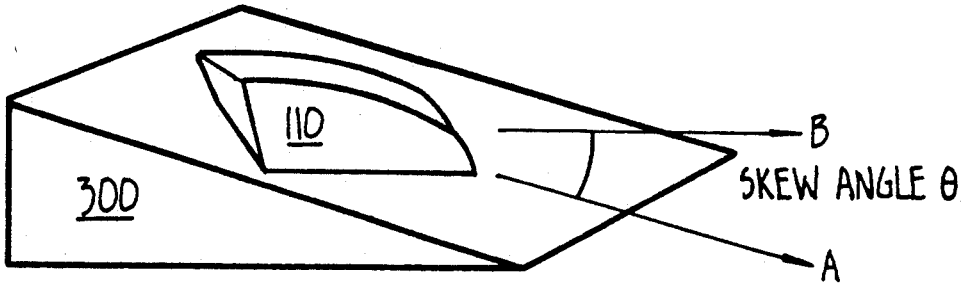
FIGS. 9B-9D are diagrams illustrating the skew angle calculation.
Figure 9C:
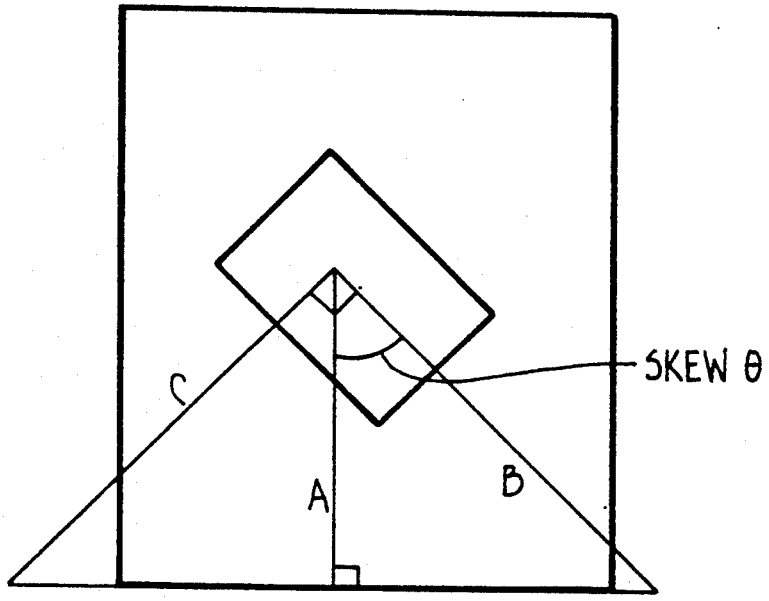
Figure 9D:
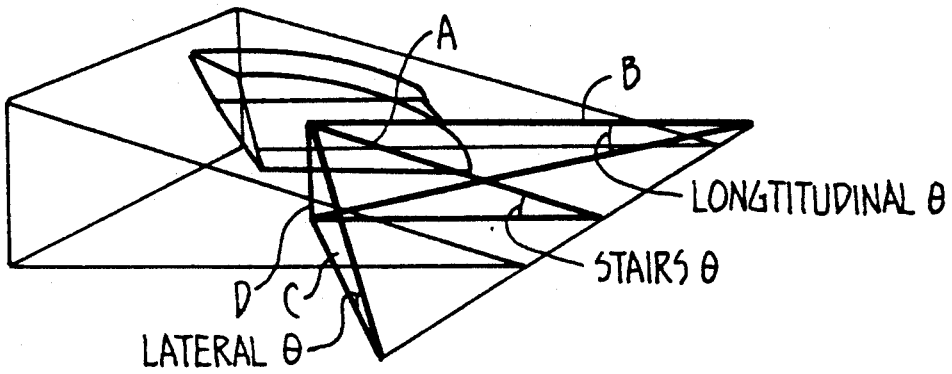

FIGS. 9B-9D illustrate the calculation of the skew angle. FIG. 9B shows the wheelchair 110 on the stairs 300, with the skew angle defined as the angle between a line B, the direction the wheelchair is pointing, and a line A down the center of the stairway.

FIG. 9C shows a top view of the slope surface of FIG. 9B. As can be seen, the following relationships apply:

$$\text{Cos (skew } \theta) = A/B$$

$$\text{Cos } (90^\circ - \text{skew } \theta) = A/C$$

FIG. 9D shows the triangles of FIG. 9C projected onto ground level. The distance between the center of the wheelchair on the sloped surface to the ground level below the sloped surface is indicated by the line D. Three different angles are indicated, longitudinal $\theta$, stairs $\theta$ and lateral $\theta$. Given the stairs $\theta$ and the maximum skew angle 15°, we can calculate the corresponding lateral $\theta$ as follows:

$$\begin{aligned} \text{Sin (lateral } \theta) &= D/C = (D/A)/(C/A) \\ &= \frac{\text{Sin (stairs } \theta)}{1/\text{Cos } (90^\circ - 15^\circ)} \\ &= \text{Sin (stairs } \theta) * \text{Cos } (75^\circ) \end{aligned}$$

Therefore, the maximum lateral inclination is:

$$\text{lateral}\theta = \text{Sin}^{-1} (\text{Sin (stairs } \theta) * \text{Cos } (75^\circ))$$

If, while vehicle 110 is on stairway 300, the measurement from the inclinometer on the X axis is zero or very small, any variation on the Y inclinometer can be assumed to be a change in the slope of the stairway or a more accurate reading of the stairway slope. Accordingly, at these points, the value of A will be updated. Rotational skew will not cause a change in the Y axis orientation without a corresponding change in the X axis orientation.

Figure 10A:
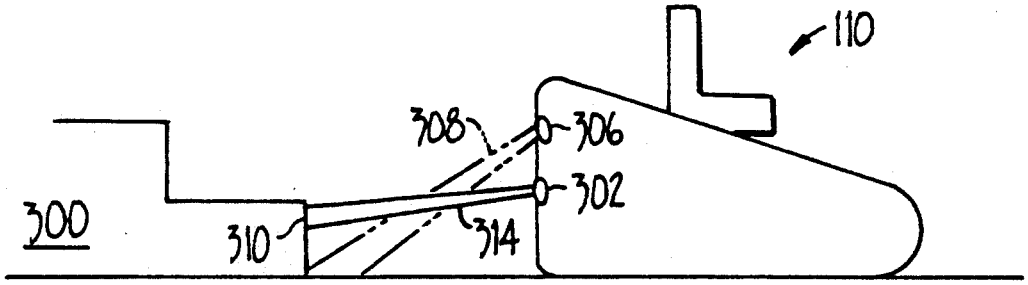
FIGS. 10A-10C are diagrams of the 2 sensor rear stair identification.
Figure 10B:
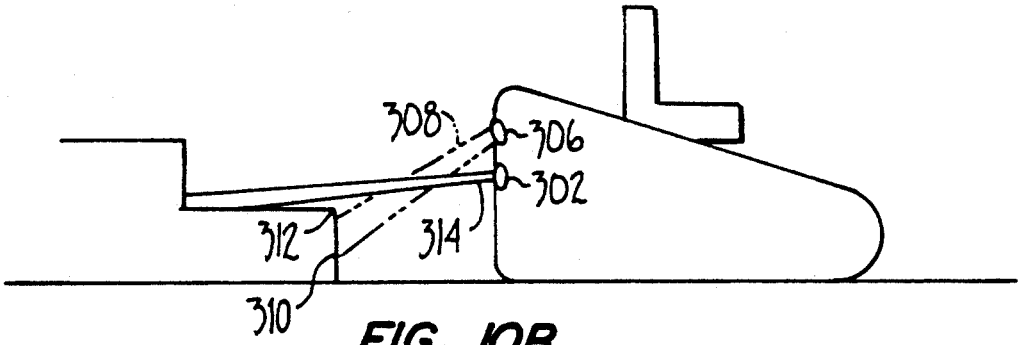
Figure 10C:
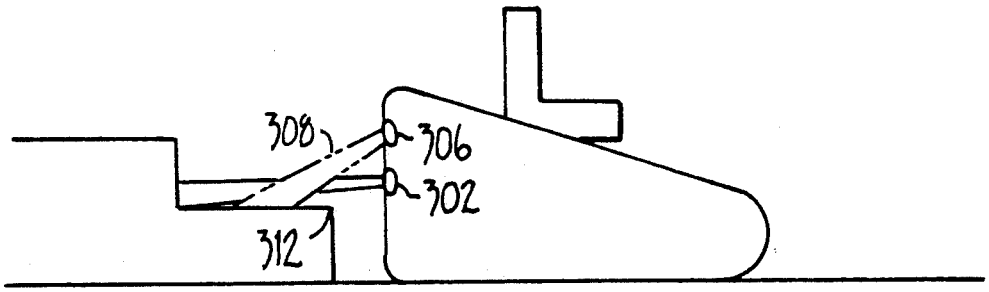

FIGS. 10A-10C illustrate the operation of the two rearward sensors. A lower sensor 302 is mounted at an angle of approximately 10° to the vertical, so that its ultrasonic beam 304 is directed outward at an angle of approximately 10° below horizontal. A second sensor 306 is mounted higher, and is angled more so that its ultrasonic beam 308 is directed approximately 40° downward from horizontal.

Beam 304 from sensor 302 is shown bouncing off of a riser 310. The processor in vehicle 110 will analyze the sensor output and determine the range to riser 310. As vehicle 110 approaches stairway 300, the processor will know the distance travelled by the chair from the sensor input from the motors driving the wheels of the vehicle. The processor will recognize the riser as being in a fixed location. As the vehicle gets closer, beam 304 will move up along riser 310 until it passes the nose 312 as shown in FIG. 10B. At this time, the distance detected by sensor 302 will jump, indicating the location of the nose. The precise location of this jump may be blurred by any number of effects, including carpeting on the stairs which may defract the beam around the nose 312.

As shown in FIG. 10B, the second beam 308 from sensor 306 will detect riser 310 as the vehicle gets closer to the stairs. As shown in FIG. 10C, beam 308 will also pass nose 312, with a jump in the distance detected. The data from sensor 306 can then be correlated with the data from sensor 302 to precisely locate the location of nose 312. The readings from sensor 302 can be used to establish a window within which the readings from sensor 306 can be examined to determine the location of the nose. Because of the greater angle downward of the beam from sensor 306, it will pass over the nose more gradually, providing a more accurate indication. For the same reason, however, the distance jump will not be as sharp, making the initial determination of the nose from sensor 302 important. The identification of the nose is especially important for deck-type stairs, which do not have a riser.

Because the processor in vehicle 110 is programmed with the physical geometric characteristics of the vehicle, once the location and height of nose 312 is known, the vehicle can begin to climb over nose 312 with a determination of how far the vehicle can climb before being required to either detect the next step or deploy a cushioning arm (for a single step). By knowing precisely the location of the nose that the chair is moving over, the distance the chair can move backwards before entering into a situation requiring a rollover is known. During this time, the vehicle can be ranging for the next step edge.

In one embodiment, the processor may store in memory a representative map of typical stair geometries. Captured data can then be matched against the stored pattern rather than doing a computationally complex algorithmic analysis of the captured data.

Figure 11:
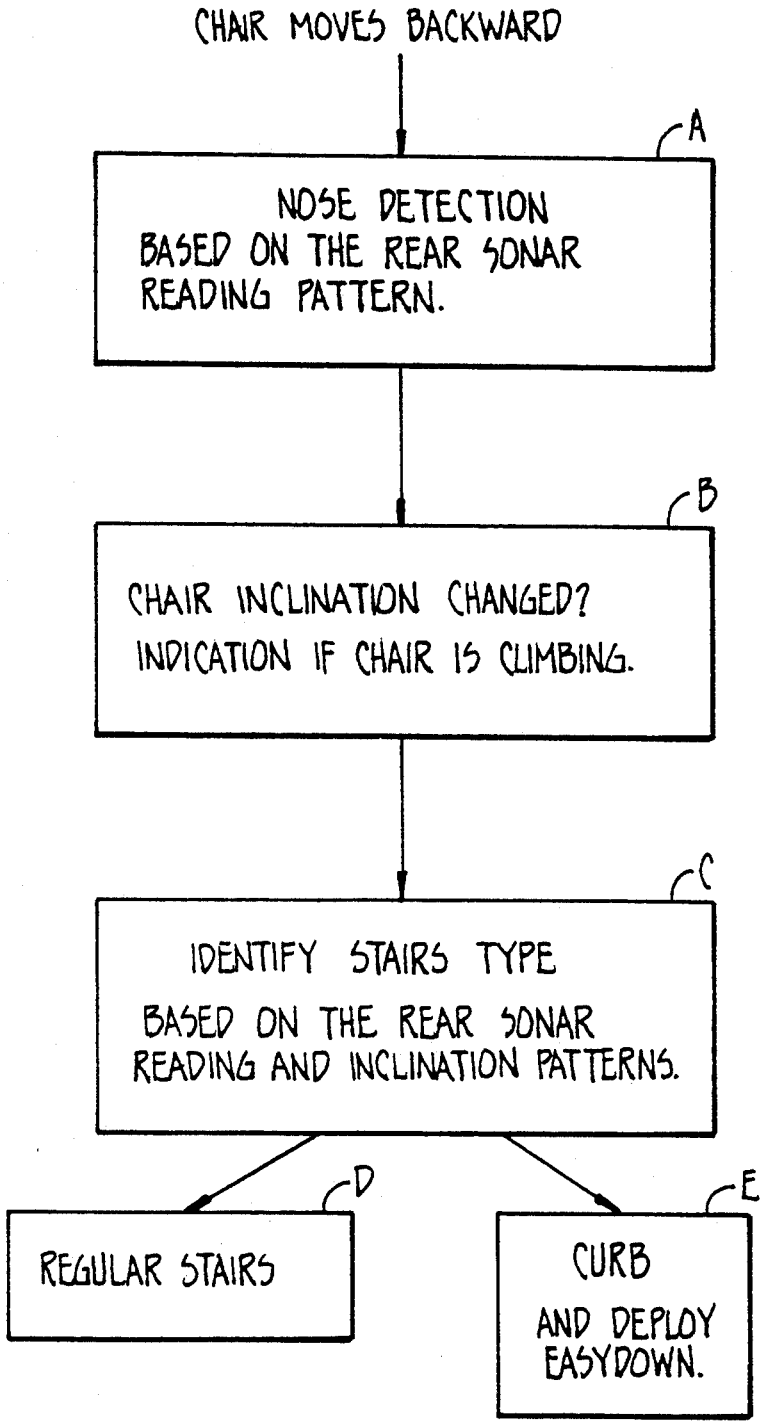
FIG. 11 is a flow chart of the stair type recognition process.

FIG. 11 is a flow chart showing the process for determining the type of stairs detected. As the chair moves backward towards the stairs, the nose of the first step is detected (step A). The inclinometer is then monitored to determine whether the chair has started climbing the stairs (step B). The inclination of the stairs is then calculated and the expected location of the nose of the next step is determined (step C). If the nose of the second step is detected where expected, a regular stairway has been encountered (step D). If no second nose is detected, this indicates a single step, or curb (step E). In this case, the easy down is deployed to allow the chair to roll over onto the top of the curb.

As will be understood by those familiar with the art, the present invention may be embodied in other specific forms without departing from the spirit or essential characteristics thereof. For example, a single forward easy down could be used, with the wheelchair moving both up and down stairs in the forward position, and the seat being made to tilt in both directions to accommodate this. Accordingly, the disclosure of the preferred embodiment of the invention is intended to be illustrative, but not limiting, of the scope of the invention which is set forth in the following claims.

APPENDIX I

PTV Control Algorithm Definition 5/12/88, J. Golini

Let:

| | |
|---|---|
| $N$ = | Number of previous terms in integral. Allowable range (0,9). |
| $J_{Tj}$ = | Joystick translational value for period $j$, where $j = 0,-N$. Allowable range (-128,127). |
| $J_{Rj}$ = | Joystick rotational value for period $j$, where $j = 0,-N$. Allowable range (-128,127). |
| $C_{Lj}$ = | Left motor encoder counts for period $j$, where $j = 0,-N$. Allowable range (-255,255). |
| $C_{Rj}$ = | Right motor encoder counts for period $j$, where $j = 0,-N$. Allowable range (-255,255). |
| $K_t$ = | Translational joystick conversion constant. Allowable range (0,1.5). |
| $K_r$ = | Rotational joystick conversion constant. Allowable range (0,.5). |
| $K_s$ = | PWM conversion constant. Allowable range (0,1.5). |
| $K_p$ = | Proportional error constant. Allowable range (-3,3). |
| $K_i$ = | Integral error constant. Allowable range (-3,3). |
| $K_d$ = | Derivative error constant. Allowable range (-10,10). |
| $K_m$ = | Motor/motor error constant. Allowable range (-10,10). |
| $X_{L-1}$ = | Previous left motor power (-255,255). |
| $X_{R-1}$ = | Previous right motor power (-255,255). |

Then:

| | | |
|---|---|---|
| $T_j$ = | $K_t J_{Tj}$ , $j=0,-N$ | Modified joystick translational values. |
| $R_j$ = | $K_r J_{Rj}$ , $j=0,-N$ | Modified joystick rotational values. |
| $E_{Lj}$ = | $T_j - R_j - C_{Lj}$ , $j=0,-N$ | Left motor observed errors. |
| $E_{Rj}$ = | $T_j + R_j - C_{Rj}$ , $j=0,-N$ | Right motor observed errors. |
| $P_L$ = | $K_p E_{L0}$ | Left motor proportional correction. |
| $P_R$ = | $K_p E_{R0}$ | Right motor proportional correction. |
| $I_L$ = | $K_i\, sum(E_{Lj}$ , $j=0,-N)$ | Left motor integral correction. |
| $I_R$ = | $K_i\, sum(E_{Rj}$ , $j=0,-N)$ | Right motor integral correction. |
| $D_L$ = | $K_d (C_{L0} - C_{L-1})$ | Left motor derivative correction. |
| $D_R$ = | $K_d (C_{R0} - C_{R-1})$ | Right motor derivative correction. |
| $M_L$ = | $K_m (E_{R0} - E_{L0})$ | Left motor/motor correction. |
| $M_R$ = | $K_m (E_{L0} - E_{R0})$ | Right motor/motor correction. |
| $X_{L0}$ = | $X_{L-1} + K_s (P_L + I_L + D_L + M_L)$ | New left motor power. |
| $X_{R0}$ = | $X_{R-1} + K_s (P_R + I_R + D_R + M_R)$ | New right motor power. |

$X_{L0}$ and $X_{R0}$ are then bounded at (-255, +255).

APPENDIX II

JOYSTICK FILTERING ALGORITHMS

SCOPE:

This Appendix describes the algorithms that are used to filter the joystick reading that are read off the analog to digital converters in the command module. The filtered readings are sent to the control module for implementation.

ALGORITHM:

NOTE:

Positive X direction is the direction of joystick straight forward.

Positive Y direction is the direction of joystick to extreme left.

1. ADDING SIGN

Xa +j Ya values read from the A/D converters are converted to Xs +j Ys by converting the unsigned numbers (from 0 to 255) to signed numbers (from -128 to +127). Negative numbers are always represented in 2's complement form. The conversion is done by complementing the MSB of the numbers.

2. ADDING HYSTERESIS

The Xs +j Ys are converted to Xsh +j Ysh by the following method:

If the MSB of the signed number is 1 then set carry else reset it. Shift the number right one bit through carry.

This adds a negligible amount of hysteresis and converts the number range from (-128 to +127) to (-64 to +63).

3. FILTERING FOR TREMOR COMPONENTS

The Xsh +j Ysh after the above processes must then be sieved by a nth order real time digital low pass filter. The cut-off frequency of this filter (from about 1.5 Hz to 15 Hz) is stored in the Key PROM as a parameter. This kind of filter takes care of patients with involuntary tremor disability.

Xsh and Ysh have to be filtered separately, which should eliminate the tremor ac components in both the translational and rotational scalers and lead to desired results.

The resulting X and Y values are termed Xf +j Yf.

4. NON-LINEAR MAPPING TO GET FINER LOW SPEED CONTROL AND DEAD BANDS

The Xf +j Yf are now mapped through either a table or another algorithm to produce Xfm +j Yfm that does the following things:

a. Small deflections of the joystick cause comparatively still smaller deviations in the Xfm +j Yfm values thereby increasing the resolution of the system in the regions close to the null position of the joystick.

Large deflections of the joystick cause comparatively still larger deviations in the Xfm +j Yfm values thereby decreasing the resolution of the system in the regions far away from the null position of the joystick.

This kind of mapping would enable the user to get finer control over the wheelchair's velocity when moving very slowly, say in the office area, where the user needs precision positioning.

A typical mapping may be obtained from the following equations:

$$Xfm = Rfm * \cos(theta_fm)$$

Low speed mode by effectively treating the speed mode bit as another bit of joystick resolution.

Thus, for instance, a value of (X, Y) = (+63, 0) received by the control means it will try to drive the chair at 3 mph if in the Low speed mode or 6 mph if in the High speed mode in the forward direction.

The scaling for maximum speed allowed may be done in either the command module or the control module.

6. CONTROLLING MAXIMUM ACCELERATIONS (translational & rotational)

The maximum accelerations are first of all going to be automatically limited by the location of the system's poles or in other words its sluggishness.

The following will limit the rate of change of X and Y separately:

If abs (Y(k) - Y(k-1)) Aym then

Yfmd = Y(k-1) + ± Aym sign of Aym same as sign of (Y(k) - Y(k-1))

else

Yfmd = Y(k)

Do similarly for X using Axm and generate Xfmd

At higher translational speeds the value of Aym needs to lower whereas it can be higher at lower speeds. So the following step is also added to better the Y value only:

Yfmd = Yfmd * Ktr / Present translational speed

7. LOWERING REVERSE SPEEDS

Reverse speeds have to be much lower than forward speeds and this is done by multiplying the X and Y values obtained from the above processes by a constant if X is found to be negative. This constant is also stored in the key PROM.

Thus

```
If X is negative then
     Xcur +j Ycur = krev * (Xfmd +j Yfmd)
else
     Xcur +j Ycur = 1 * (Xfmd +j Yfmd)
where
     krev - reverse speed factor constant
     stored in key PROM.  Typical values
     of krev could be between .1 and .25
     (Xcur +j Ycur) are then the values
transmitted to the Control Module.
```

What is claimed is:

1. A stair-climbing personal transport vehicle comprising:

a first forward ranging sensor;

a second rearward ranging sensor;

electronic means, responsive to said sensors, for determining the slope of a stairway and for controlling a motor for said vehicle to prevent movement over a stairway exceeding predetermined geometric characteristics;

means, responsive to a determined slope from said electronic means, for inclining a seat on said vehicle to a minimum safe angle for preventing rollover of said vehicle for said slope to modify the center of gravity of said vehicle and user to prevent rollover of said vehicle on said stairway;

controller means for driving said motor in accordance with an algorithm;

enabling means, coupled to said controller means, for enabling operation of said vehicle in response to a key code; and a detachable, programmable memory for providing said key code to said enabling means and constants for said algorithm.

2. The vehicle of claim 1 wherein said electronic means includes means for preventing, at all times on a stairway, movement other than forward down a stairway and backwards up a stairway.

3. The vehicle of claim 1 further comprising:

a first inclinometer for measuring tilt along a Y axis extending forward to rearward through said vehicle;

a second inclinometer for measuring tilt from an X axis extending from one side to another of said vehicle; and means, coupled to said first inclinometer, said second inclinometer and said controller means, for determining the rotational skew of said vehicle relative to said stairway slope and providing said rotational skew to said controller means for preventing more than a predetermined amount of rotational skew.

4. The vehicle of claim 1 further comprising:

a third, rearward sensor mounted at an angle to said second, rearward sensor; and means, coupled to said second and third sensors, for detecting the nose of a stair from an output of said third sensor within a window defined by said second sensor, an output of said means for detecting being provided to said electronic means for determining the slope of said stairway.

5. A control system for a personal transport vehicle having a motor, comprising:

a ranging sensor;

electronic means, responsive to said sensor, for determining the slope of a stairway;

a first inclinometer for measuring tilt along a Y axis extending forward to rearward through said vehicle;

a second inclinometer for measuring tilt from an X axis extending from one side to another of said vehicle;

means, coupled to said first and second inclinometers and said electronic means, for determining the rotational skew of said vehicle relative to said stairway slope;

control means, coupled to said electronic means, said means for determining rotational skew and said motor, for preventing movement over a stairway exceeding predetermined geometric characteristics and preventing more than a predetermined rotational skew; and said control means for also adjusting the direction of said vehicle responsive to said rotational skew.

6. A stair-climbing personal transport vehicle comprising:

a first forward ranging sensor;

a second rearward ranging sensor;

electronic means, responsive to said sensors, for determining the slope of a stairway and for controlling a motor for said vehicle to prevent movement over a stairway exceeding a predetermined slope;

means, responsive to said determined slope from said electronic means, for inclining a seat on said vehicle to modify the center of gravity of said vehicle and user to prevent rollover of said vehicle on said stairway;

controller means for driving said motor in accordance with an algorithm;

enabling means, coupled to said controller means, for enabling operation of said vehicle in response to a key code;

a detachable, programmable memory for providing said key code to said enabling means and constants for said algorithm;

a first inclinometer for measuring tilt along a Y axis extending forward to rearward through said vehicle;

a second inclinometer for measuring tilt from an X axis extending from one side to another of said vehicle; and means, coupled to said first and second inclinometers and said controller means, for determining the rotational skew of said vehicle relative to said stairway slope and providing said rotational skew to said controller means for preventing more than a predetermined amount of rotational skew.

7. A stair-climbing personal transport vehicle comprising:

a first forward ranging sensor;

a second rearward ranging sensor;

electronic means, responsive to said sensors, for determining the slope of a stairway and for controlling a motor for said vehicle to prevent movement over a stairway exceeding a predetermined slope;

means, responsive to said determined slope from said electronic means, for inclining a seat on said vehicle to modify the center of gravity of said vehicle and user to prevent rollover of said vehicle on said stairway;

controller means for driving said motor in accordance with an algorithm;

enabling means, coupled to said controller means, for enabling operation of said vehicle in response to a key code;

a detachable, programmable memory for providing said key code to said enabling means and constants for said algorithm;

a third, rearward sensor mounted at an angle to said second, rearward sensor; and means, coupled to said second and third sensors, for detecting the nose of a stair from an output of said third sensor within a window defined by said second sensor, an output of said means for detecting being provided to said electronic means for determining the slope of said stairway.

8. A stair-climbing personal transport vehicle comprising:

at least one ranging sensor for detecting a change between inclined and substantially horizontal surfaces;

a cushioning arm for deployment on one of said surfaces;

means, coupling said cushioning arm to said vehicle, for slowing the rollover of said vehicle onto one of said surfaces;

means, responsive to said sensor, for deploying said cushioning arm;

electronic means, responsive to said sensor, for determining the slope of a stairway and for controlling a motor for said vehicle to prevent movement over a stairway exceeding predetermined geometric characteristics;

means, responsive to the slope from said electronic means, for inclining a seat on said vehicle to modify the center of gravity of said vehicle and user to prevent rollover of said vehicle on said stairway;

controller means for driving said motor in accordance with an algorithm;

enabling means, coupled to said controller means, for enabling operation of said vehicle in response to a key code;

a detachable, programmable memory for providing said key code to said enabling means and constants for said algorithm.

9. A stair-climbing personal transport vehicle comprising:

at least one ranging sensor for detecting a change between inclined and substantially horizontal surfaces;

a cushioning arm for deployment on one of said surfaces;

means, responsive to said sensor, for deploying said cushioning arm;

a fluid-filled tube coupled to one of said vehicle and said cushioning arm;

a piston extending into said tube and coupled to a one of said vehicle and said cushioning arm not coupled to said tube;

means for restricting the flow of said fluid to limit the speed at which the combination of said tube and said piston compresses; and a solenoid activated latch for holding said cushioning arm in an up position.

10. A stair-climbing personal transport vehicle comprising:

at least one ranging sensor for detecting a change between inclined and substantially horizontal surfaces;

a cushioning arm for deployment on one of said surfaces;

means, responsive to said sensor, for deploying said cushioning arm;

a fluid-filled tube coupled to one of said vehicle and said cushioning arm;

a piston extending into said tube and coupled to a one of said vehicle and said cushioning arm not coupled to said tube; and means for restricting the flow of said fluid to limit the speed at which the combination of said tube and said piston compresses;

wherein said means for restricting comprises a one-way fixed orifice in said piston.

11. A stair-climbing personal transport vehicle comprising:

at least one ranging sensor for detecting a change between inclined and substantially horizontal surfaces;

a cushioning arm for deployment on one of said surfaces;

means, coupling said cushioning arm to said vehicle, for slowing the rollover of said vehicle onto one of said surfaces;

means, responsive to said sensor, for deploying said cushioning arm;

electronic means, responsive to said sensor, for determining the slope of a stairway and for controlling a motor for said vehicle to prevent movement over a stairway exceeding a predetermined slope;

means, responsive to a determinied slope from said electronic means, for inclining a seat on said vehicle to a variable angle to modify the center of gravity of said vehicle and user to prevent rollover of said vehicle on said stairway;

controller means for driving said motor in accordance with an algorithm;

enabling means, coupled to said controller means, for enabling operation of said vehicle in response to a key code; and a detachable, programmable memory for providing said key code to said enabling means and constants for said algorithm.

12. A control system for a personal transport vehicle comprising:

a ranging sensor;

electronic means, responsive to said sensor, for determining the slope of a stairway;

a first inclinometer for measuring tilt along a Y axis extending forward to rearward through said vehicle;

a second inclinometer for measuring tilt from an X axis extending from one side to another of said vehicle;

means, coupled to said first and second inclinometers and said electronic means, for determining the rotational skew of said vehicle relative to said stairway slope; and control means for adjusting the direction of said vehicle responsive to said rotational skew.

* * * * *